US005155971A

United States Patent [19]

Zopf

[11] Patent Number: 5,155,971

[45] Date of Patent: Oct. 20, 1992

[54] PACKAGING APPARATUS

[75] Inventor: Thomas J. Zopf, Largo, Fla.

[73] Assignee: Autoprod, Inc., Clearwater, Fla.

[21] Appl. No.: 845,061

[22] Filed: Mar. 3, 1992

[51] Int. Cl.[5] ..... B65B 31/04

[52] U.S. Cl. ..... 53/432; 53/408; 53/477; 53/510

[58] Field of Search ..... 53/432, 433, 510, 511, 53/408, 403, 405, 407, 97, 109, 79, 477; 426/392, 396, 418, 419, 413, 316

[56] References Cited

U.S. PATENT DOCUMENTS

| | | | |
|---|---|---|---|
| 3,398,500 | 8/1968 | Inman | 53/432 |
| 3,508,373 | 4/1970 | Robinson, Jr. | 53/408 |
| 3,668,820 | 6/2972 | Parvin et al. | 53/510 |
| 4,114,348 | 9/1978 | Mahaffy et al. | 53/510 X |
| 4,294,859 | 10/1981 | Lundquist et al. | 426/410 |
| 4,409,252 | 10/1983 | Buschkens et al. | 426/396 |
| 4,624,009 | 11/1986 | Harder | 53/432 |
| 4,809,486 | 3/1989 | Chanel | 53/510 |
| 4,896,479 | 1/1990 | Gannon | 53/432 |
| 4,905,454 | 3/1990 | Sanfilippo et al. | 53/432 |
| 4,909,022 | 3/1990 | Kubis et al. | 53/510 |
| 4,982,555 | 1/1991 | Ingemann | 53/510 X |

*Primary Examiner*—James F. Coan
*Attorney, Agent, or Firm*—Pettis & McDonald

[57] ABSTRACT

A packaging apparatus that seals a product within a container while under a controlled environment. The container, holding a product and having a lid tacked to the open end thereof leaving vents between the lid and the container. The container is enclosed within a chamber having a device for controlling the flow of fluid into and out of the chamber. The chamber and container are evacuated and then flushed with an inert fluid at least once. While the container is still within the chamber the lid is completely peelably sealed to the container.

15 Claims, 10 Drawing Sheets

PACKAGING APPARATUS

BACKGROUND OF THE INVENTION

1. Field of the Invention

The present invention relates to a packaging apparatus in which a produce is sealed within a container. More particularly to a process which evacuates, flushes and seals the container within a controlled environment.

2. Description of the Prior Art

It is well known that the quality of most products, particularly foods, can be best maintained during storage if they are placed in a sealed container in which the amount of oxygen has been significantly reduced. In foods the presence of oxygen within the container stimulates the growth of bacteria and molds, causing loss of flavor and eventually spoilage. The less oxygen remaining within a sealed package the greater the efficiency of the packaging apparatus and the longer the product will last during storage.

Various types of packaging machines have been developed to reduce the amount of oxygen remaining within a sealed package. For example, U.S. Pat. No. 4,409,252, issued to Buschkens et al., discloses a number of work stations at which a tack seal attaches a lid to a container, gas is blown between the lid and the container and then the container is sealed at the final station. There is no means for preventing entrance of oxygen or other contaminants during the container's transfer to the sealing station or during the final sealing process.

U.S. Pat. No. 4,624,099, issued to Harder, discloses an apparatus that evacuates air simultaneously from above and below the product container, the container is filled with an inert gas and then the container is removed from the chamber and the container is sealed. The sealing of the container occurs at a station separate from the back filling process, allowing contaminants to enter between stations.

U.S. Pat. No. 4,294,859, issued to Lundquist et al., discloses an apparatus having a first chamber into which the product and container are sealed, the air is evacuated from the chamber, the lid is partially sealed, and then the chamber is flushed with an inert gas. The food unit is then removed from the chamber and the container is flushed a second time outside the chamber. The food unit is then moved into a second chamber, the chamber is evacuated, and the lid to the container is sealed. Alternatively, the food unit may be filled with a gas prior to sealing. In this invention the flushing occurs separately from the final vacuum and final seal, losing the benefits of the flushing by allowing contaminants to enter the food units before they enter the final chamber.

U.S. Pat. No. 3,668,820, issued to Parvin et al., discloses an apparatus in which a lid is tack sealed to a food unit, the unit is then placed within a chamber, the chamber is evacuated, and the unit is sealed. The patent does not disclose any means for flushing with an inert gas.

U.S. Pat. No. 3,508,373, issued to Robinson, discloses simultaneous evacuation and flushing of a food unit; however, the sealing process is accomplished at a separate station, permitting contaminants to enter the food unit during the transfer from one station to another.

SUMMARY OF THE INVENTION

The present invention provides an improved apparatus for removal of air from a product container and its replacement with an inert gas. The apparatus comprises a plurality of stations to which a transport carrier moves a product container along a predetermined path. The container is comprised of a closed bottom, at least one side, an open top, a top edge with a lip attached thereon and a separately attachable heat sealable lid. The transport carrier has a receptacle in which the container is received so that the lip of the container rests on the exterior surface of the transport carrier adjacent the receptacle. A transport means moves the transport carrier along the path between the stations in a predetermined sequence. The packaging apparatus is mounted on at least one support frame. The containers, filled with a product and having a separately attachable, heat sealable lid aligned with and placed proximal to the lip of the container, are transported by a transport carrier to the various stations.

The means for transporting the transport carrier places the container in alignment with a means for tacking the lid to the container. At this station the lid is partially attached to the lip of the container.

At a subsequent station a container and a portion of the transport carrier is interposed between an upper portion of a chamber, or upper chamber portion, and the lower portion of a chamber, or lower chamber portion. The upper chamber portion comprises a hollow body having a closed top, open bottom and at least one side. The lower chamber portion comprises a hollow body having an open top, closed bottom and at least one side. The upper chamber portion is movably connected to the apparatus support frame by an upper chamber portion support structure that supports the upper chamber portion for movement between an open and a closed position. The lower chamber portion is movably connected to the apparatus support frame by a lower chamber portion support structure for movement between an open and a closed position. An actuating means selectively moves the lower chamber portion and the upper chamber portion between the open position, in which they are spaced apart from the transport carrier, to the closed position. In the closed position the open bottom of the upper chamber portion and the open top of the lower chamber portion are sealed against the transport carrier such that one container is contained within the chamber formed thereby.

A means for evacuating the chamber is connected in fluid flow relation to the upper chamber portion and to the lower chamber portion. A means for flushing the chamber is connected in fluid flow relation to the upper chamber portion and to the lower chamber portion. A means for controlling the flow of fluid selectively controls the flow of fluid between the means for evacuating the chamber and the chamber and also selectively controls the flow of fluid between the flushing means and the chamber.

A seal plate assembly is movably housed within the upper chamber portion of each chamber. The seal plate assembly comprises a seal plate, a heating means and a seal plate operating means that selectively moves the seal plate between a sealing position and a storage position. The seal plate has a continuous ridge projecting downwardly therefrom, the ridge being configured to overlie the lip of the container so that, when the seal plate is in the sealing position, a lid is interposed between the ridge of the seal plate and the lip of the container. The heating means is connected to the continuous ridge to provide heat to the ridge, thereby removably attaching the heat sealable lid to the lip of the container. The transport carrier is then moved to the last station where the containers are removed from the packaging machine.

A controlling means controls the operation of the packaging apparatus to effect the predetermined sequence of operations previously discussed, such that a filled container first has a lid tack sealed thereon, and then the container is placed within a chamber where it is evacuated and flushed in a single cycle. The air is evacuated from both the upper and lower chamber portions generally simultaneously. Also, the upper and lower chamber portions are flushed with an inert fluid generally simultaneously. After the container is flushed with a fluid, it is sealed and moved to an off-load station for removal from the packaging apparatus. The evacuation, flushing and sealing operations are all performed at a single station within the chamber.

BRIEF DESCRIPTION OF THE DRAWINGS

A particularly preferred embodiment of the apparatus of the invention will be disclosed in detail in which.

Similar reference characters refer to similar parts throughout the several view of the drawings.

DETAILED DESCRIPTION

Figure 1:
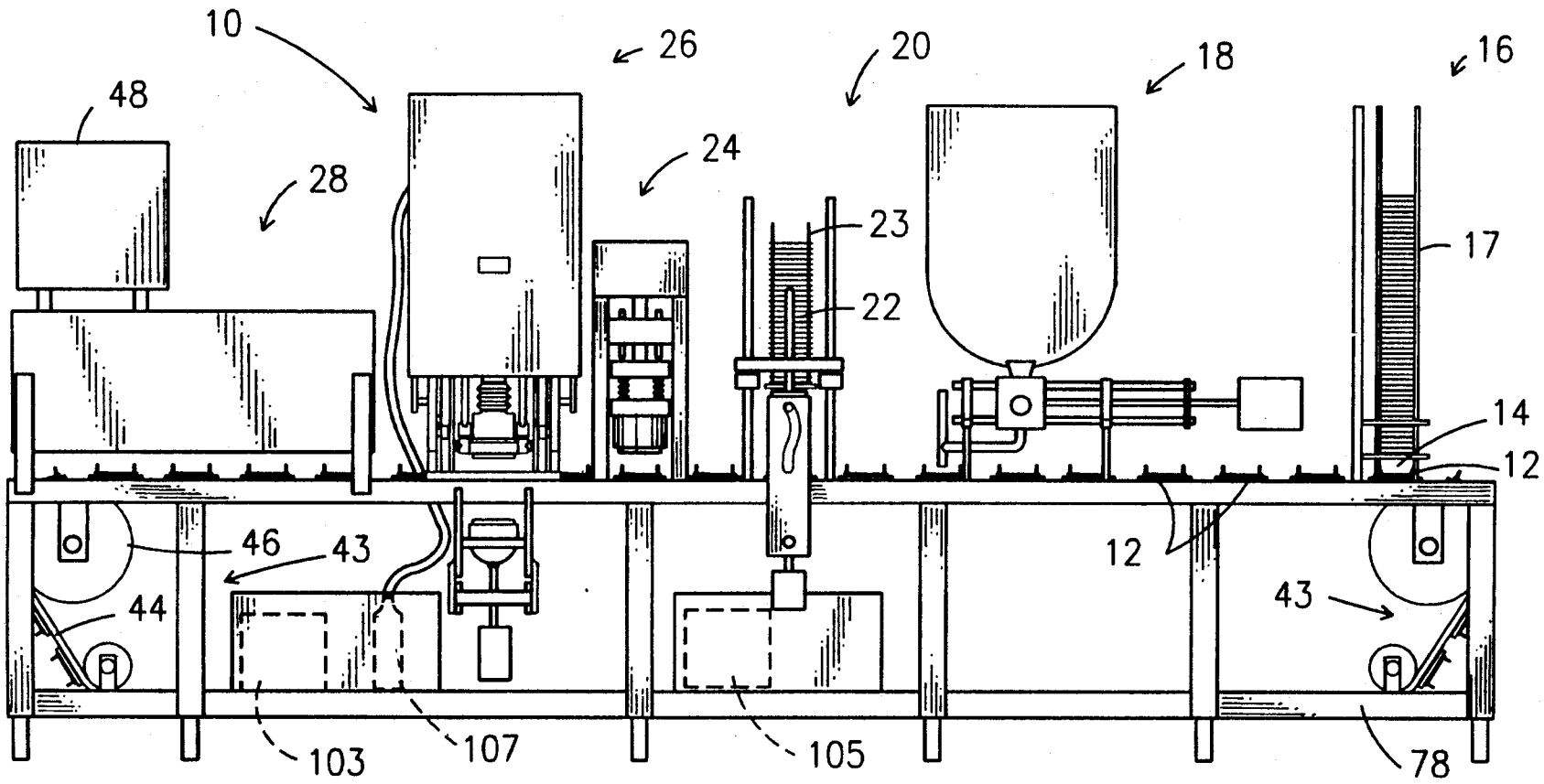
FIG. 1 is a front elevation view of the preferred embodiment showing in simplified detail the path of the transport carrier as it passes through the stations of the packaging apparatus.

FIG. 1 illustrates a preferred embodiment of the packaging apparatus of this invention, generally indicated as 10, presenting a general representation of the apparatus at each station that is defined in FIGS. 2 through 13 and further described below. A transport carrier 12, as shown in greater detail in FIG. 2, transports the product containers 14 along a predetermined path between the various portions of the packaging apparatus, which, for convenience, have been identified in the preferred embodiment 10 as a series of stations. For convenience, the various portions of the packaging apparatus may be combined into fewer stations or divided into additional stations. In this preferred embodiment 10, provision is made for loading the containers 14 in the transport carrier 12, for filling the containers 14, for placing the heat sealable lid 22 in alignment with and adjacent to the container 14 and for off-loading the filled and sealed containers 14 from the packaging apparatus 10. These portions of the packaging apparatus 10 are well known in the art, and various types of such apparatus, or other means, such as hand filling and loading, can be effectively used, particularly when packaging different types of product.

In this embodiment a container de-nester, shown generally as 16, is used to place the lid 22 in alignment with and adjacent to the container 14. This device is conventional and well known by persons skilled in the art. The de-nester 16, located at the first station, utilizes a vacuum pull down to pull the containers 14 from a container holder 17, so that they drop one at a time into the transport carrier 12. Many other types of de-nesters may be used, including but not limited to, screw de-nesters, overhead vertical feed, horizontal transfer from a conveyor and hand loading. Conveniently, the transport carrier 12 in the preferred embodiment simultaneously holds four containers; therefore, in this preferred embodiment four de-nesters are required.

In this embodiment the piston filler, shown generally as 18 in FIG. 1, is conventional and well known by persons skilled in the art. This apparatus, shown at the second station, is used to fill the container 14 with product. Many other types of filling apparatus may be used, including but not limited to, a volumetric pocket filler, an auger filler, a net weight scale filler and, of course, hand filling.

In this embodiment the lid positioner 20 is a pick and place device that is well known by those skilled in the art. The pick and place device, shown at the third station, utilizes a reciprocating arm (not shown) with a suction cup (not shown). A vacuum generator (not shown) reduces the pressure in the suction cup to hold the lid while the arm plucks the lid 22 from a stack holder 23 and pivots approximately 180 degrees to place the lid 22 adjacent to the container 14.

The tacking means, generally 24, is located at station four, and the evacuating, flushing and sealing means, generally 26, is located at station five. Stations four and five will be discussed in detail below.

In this embodiment the off-load device, generally 28, is a bottom up chain and bar mechanism that sweeps the containers 14 onto a plate or tray holder or onto a conveyor. This device is well known to those skilled in the art. Other similar devices may be used to provide the same result.

Figure 2:
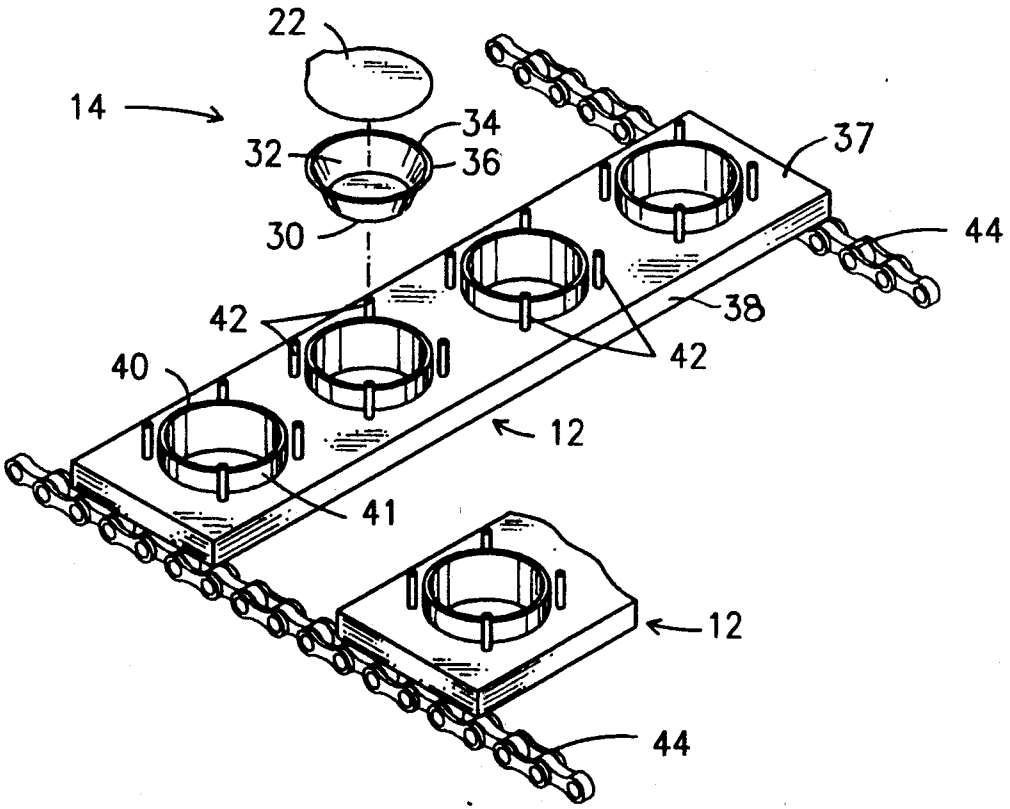
FIG. 2 is a perspective view of two transport carriers with one container exploded therefrom for illustrative purposes.

The container 14, as shown in FIG. 2, is comprised of a closed bottom 30, an open top 32, a top edge 34 with a lip 36 attached thereon and a separately attachable heat sealable lid 22. The lip 36 may be a flat flange, a rolled edge or other convenient configuration. The container 14 in the preferred embodiment is a semi-rigid construction; however, the apparatus may be modified if necessary to process containers of various sizes, configurations, and types of construction. In this preferred embodiment a plurality of transport carriers 12 are configured to receive the particular container 14 that is to be processed. In the packaging apparatus 10 of the preferred embodiment, the transport carrier 12 comprises a flat plate 38 that has at least one receptacle 40 therein, a sealing lip support ring 41 projecting upwardly and at least one element 42 projecting upwardly in relation to the plate 38, when the carrier is passing through the various stations for processing. In the preferred embodiment element 42 is conveniently a series of four posts 42 positioned about the receptacle 40 and spaced apart to receive a lid 22. Receptacle 40 is conveniently a hole 40 through plate 38 sized to receive the container 14 whereby the lip 36 rests upon the support ring 41 of the plate 38 and is positioned between the posts 42.

The transport carrier 12 is moved between the stations by a means for transporting, a conventional drive system, generally 43, consisting conveniently of a chain 44, sprockets 46 and a drive motor (not shown). The transport carriers 12 in the preferred embodiment are positioned by an indexing drive (not shown) capable of tracking the operative positions and providing that information to the means for controlling the operation of the packaging apparatus 48, a computer operated control system. Drive system 43 is well known in the art and may take a number of different forms that are suitable for a packaging apparatus of this type. The controlling means shown schematically as 48 also controls the predetermined sequence of steps accomplished by each portion of the apparatus at each station.

Figure 3:
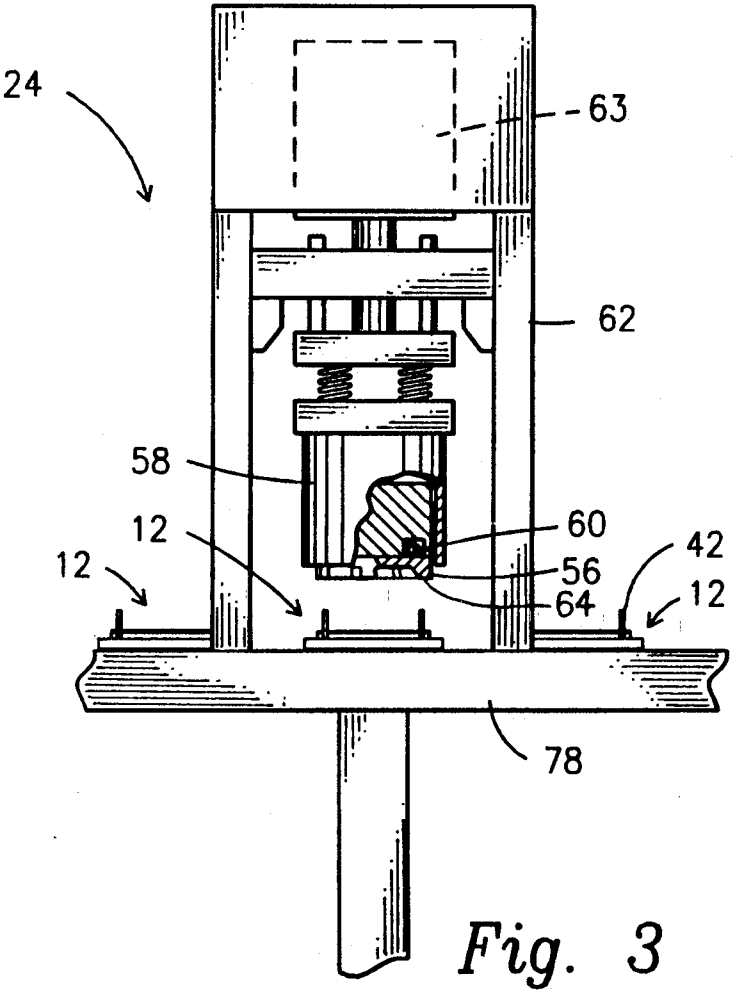
FIG. 3 is a detailed front elevation view of the means for tack sealing the lid to the container.

The means for tacking 24 tacks a lid 22 to the lip 36 of the container 14. The tacking means 24, as illustrated in FIG. 3, comprises a tack plate 56, shown more clearly in FIG. 5, that is attached to a head 58, which contains a heating element 60 therein. The heat 58 is suspended from a tacking support frame 62. The head 58 is moved downwardly by a means for placing the heated tack plate ridge 64 in contact with the lid 22, conveniently an air activated piston 63 so that a discontinuous ridge 64, shown in FIG. 5, that extends from the tack plate 56 makes firm contact with the lid 22. The discontinuous ridge 64 is heated by heating element 60 so that the heat sealable lid is removably attached to the lip 36 of the container 14 in a predetermined pattern. The pattern of sealed areas and open areas, or vents, between the lid 22 and lip 36 is created by the discontinuity of the ridge. After the tacking is completed the head 58 is returned to its storage position.

After the lid 22 is tacked to the lip 36 the container 14 is moved in the transport carrier 12 by the drive system 43 to a subsequent station where the evacuating, flushing and sealing means 26 is actuated by the controlling means 48. The evacuating, flushing and sealing means 26 is illustrated more clearly in FIGS. 6 through 10. In FIG. 9 it can be seen that the evacuation flushing and sealing means 26 comprises a chamber, shown generally as 66, which is further comprised of an upper chamber portion, shown generally as 68, and a lower chamber portion, shown generally as 70. The upper chamber portion 68 comprises a hollow body having a closed top 72, an open bottom 74 and at least one side 76. The upper chamber portion 68 is movably connected to the support frame 78 by the upper chamber support structure, conveniently a first hollow tubular member 80 and a second hollow tubular member 82. These members 80 and 82 support the upper chamber portion 68 for movement between an open position and a closed position. The first end 84 of the first hollow tubular member 80 and the first end 86 of the second hollow tubular member 82 are connected in fluid flow relationship to the upper chamber portion 68.

Figure 7:
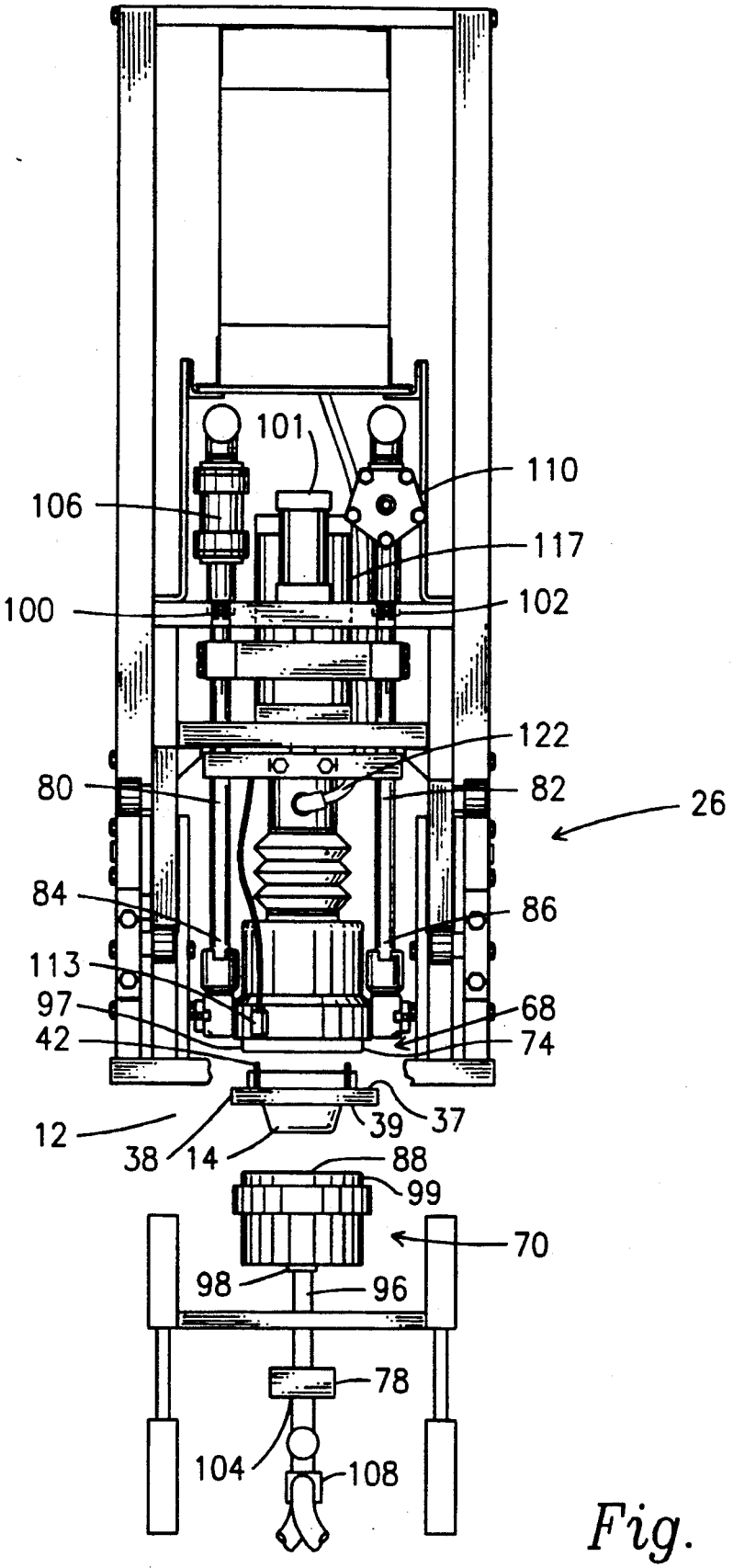
FIG. 7 is a front elevational view of the apparatus shown in FIG. 6.

The lower chamber portion 70 is comprised of a hollow body having an open top 88, a closed bottom 90 and at least one side 92. The lower chamber portion 70 is movably connected to the support frame 78 as seen in FIG. 7, by the lower chamber support structure, conveniently a conduit 96, for movement between an open and a closed position. The first end 98 of the hollow shaft 96 is connected in fluid flow relationship to the bottom 90 of the lower chamber portion 70.

The support frame 78 and the other parts attached thereto may be conveniently constructed from any suitable metal or other suitable materials, including, but not limited to steel, aluminum or iron. Stainless steel is preferred for areas having contact with food, for example, the piston filler 18.

An actuating means, conveniently a pair of double acting air cylinders and pistons 101, operated by compressed air, controlled by a solenoid valve (not shown) that is controlled by the controlling means 48, selectively moves the lower chamber portion 70 and the upper chamber portion 68 between an open position and a closed position. The open position is disclosed in FIGS. 7 and 8, where the open bottom 74 of the upper chamber portion 68 is spaced apart from the transport carrier 12, and the open top 88 of the lower chamber 70 is also spaced apart from the transport carrier 12. The open position permits the transport carrier 12 and container 14 carried thereby to be interposed between the lower chamber portion 70 and the upper chamber portion 68. FIG. 9 illustrates the creation of the chamber 66 by the placement of the upper chamber portion 68 and the lower chamber portion 70 in the closed position. In the closed position the open bottom 74 of the upper chamber portion 68 with seal 97 attached thereon sealingly engages the top surface 37 of plate 38 of the transport carrier 12 and the open top 88 of the lower chamber portion 70 with seal 99 attached thereon sealingly engages the bottom surface 39 of the flat plate 38 of the transport carrier 12.

A means for evacuating the chamber, conveniently an evacuation pump 103, is connected in fluid flow relationship with the second end 100 of the first tubular member 80, and a means for flushing the chamber, conveniently a pump 105, is connected in fluid flow relationship to a source of inert fluid 107 and to the second end 102 of the second tubular member 82. The second end 104 of the conduit 96, which can be seen in FIG. 7, is connected in fluid flow relationship with the evacuating means 103 and with the flushing means 105.

A means for controlling the flow of fluid into and out of chamber 66 are provided and may conveniently comprise valve means, and in the preferred embodiment a set of four valves, each of which are selectively adjustable between a closed position and an open position by the controlling means 48. In FIG. 7 can be seen the first valve 106 that is interposed in fluid flow relation between the evacuating means and the upper chamber portion 68. A second valve 108 is interposed in fluid flow relation between the evacuating means and the lower chamber portion 70. A third valve 110 is interposed in fluid flow relation between the flushing means and the upper chamber portion 68. A fourth valve 112 is interposed in fluid flow relation between the flushing means and the lower chamber portion 70. In the preferred embodiment the third and fourth valves control the flow of nitrogen or other inert gas used in flushing the containers 14 when in the chamber 66. Solenoid activated valves are well known in the art and any suitable such valves may be used, including valves which may combine the functions of two valves, e.g. 108 and 112. In the preferred embodiment a sensor 113 is connected to each chamber 66 and to the means for controlling the valves (not shown) to measure the existing pressure within each chamber 66, so that each valve of each set of valves may be independently operated to provide a predetermined uniform pressure within each chamber 66. In addition, the valves may be controlled so that the first valve 106 and the second valve 108 of each set of valves are closed a predetermined time after the third valve 110 and the fourth valve 112 are opened, so that the flushing fluid enters the chamber 66 before the evacuation step is complete, thus helping to ensure that the maximum amount of oxygen has been removed from the chamber 66 and the container 14.

Figure 5:
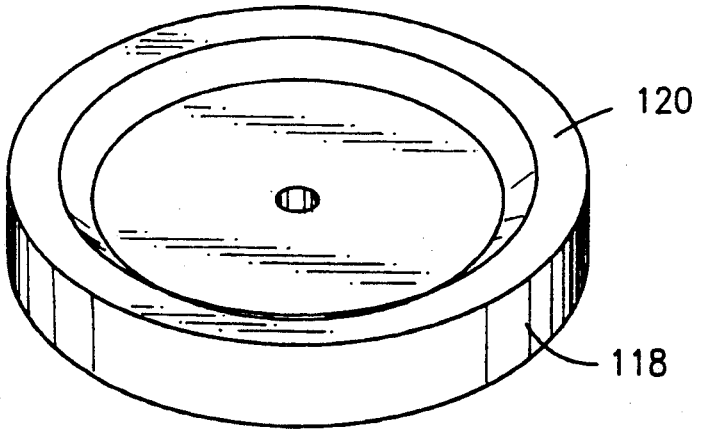
FIG. 5 is a perspective view of the seal plate.
Figure 6:
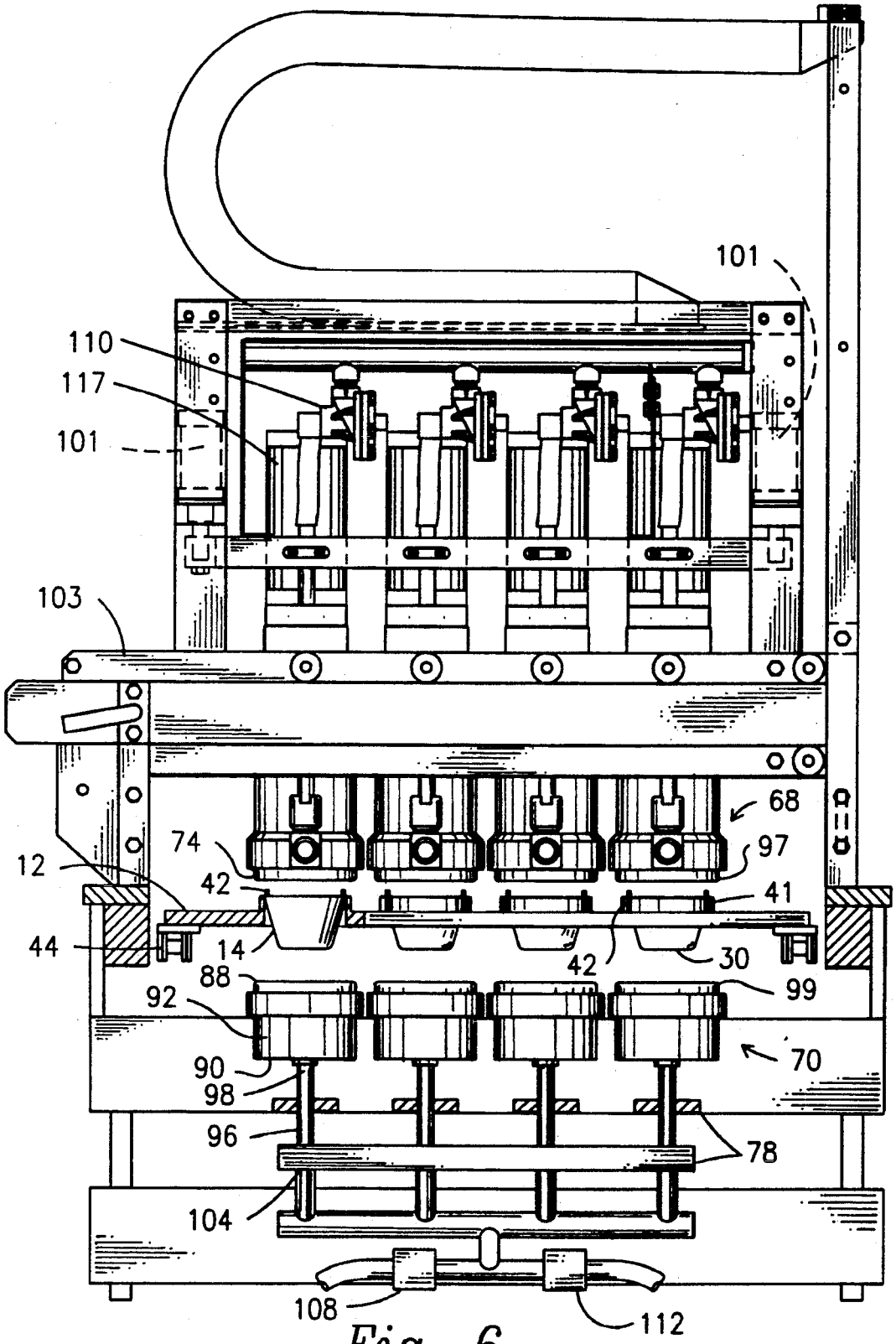
FIG. 6 is a side elevation view of the preferred embodiment of the means for evacuating, flushing and sealing the container.
Figure 8:
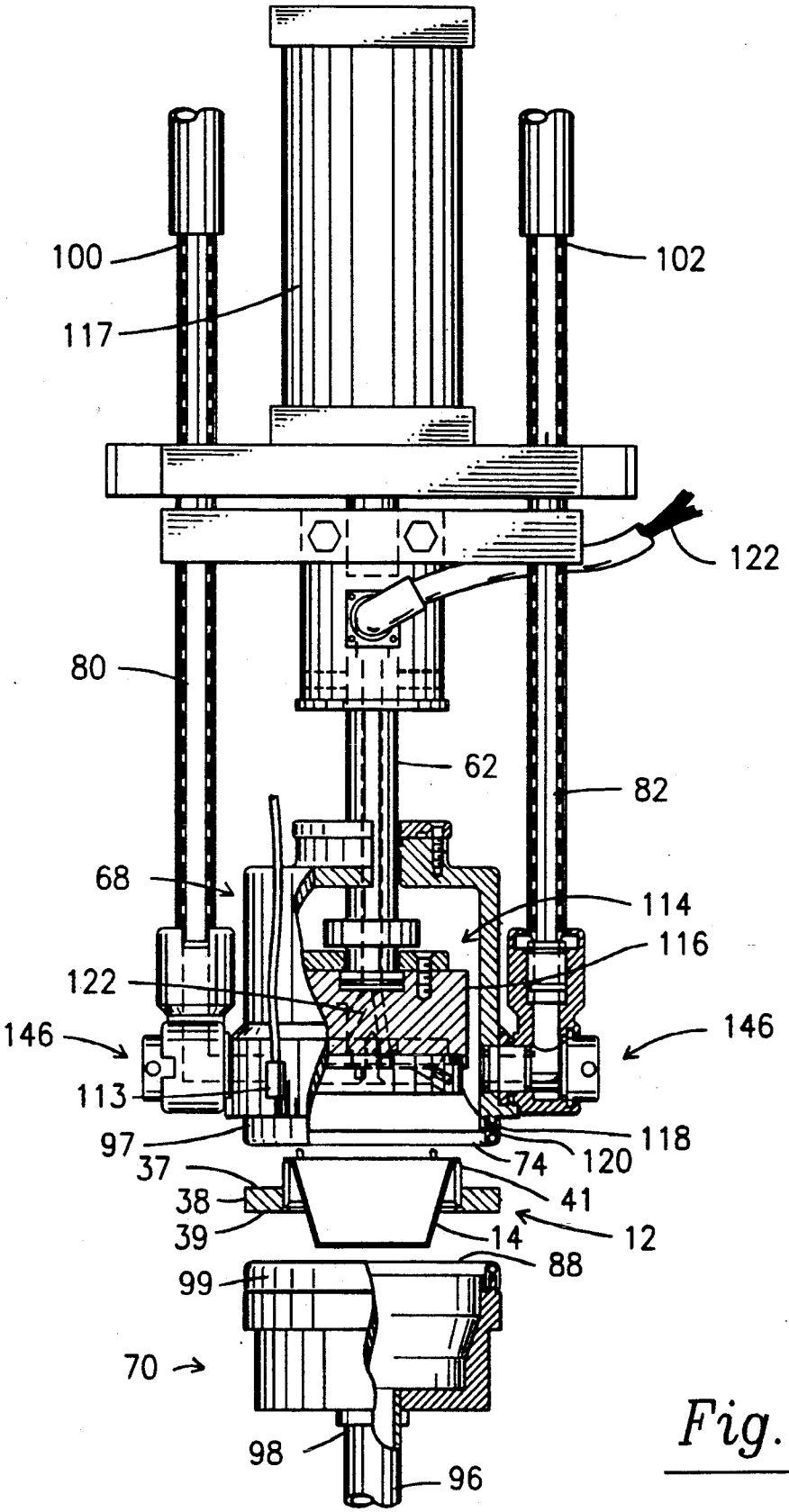
FIG. 8 is a detailed front elevational view of FIG. 7 illustrating the upper chamber portion and the lower chamber portion in the open position.
Figure 9:
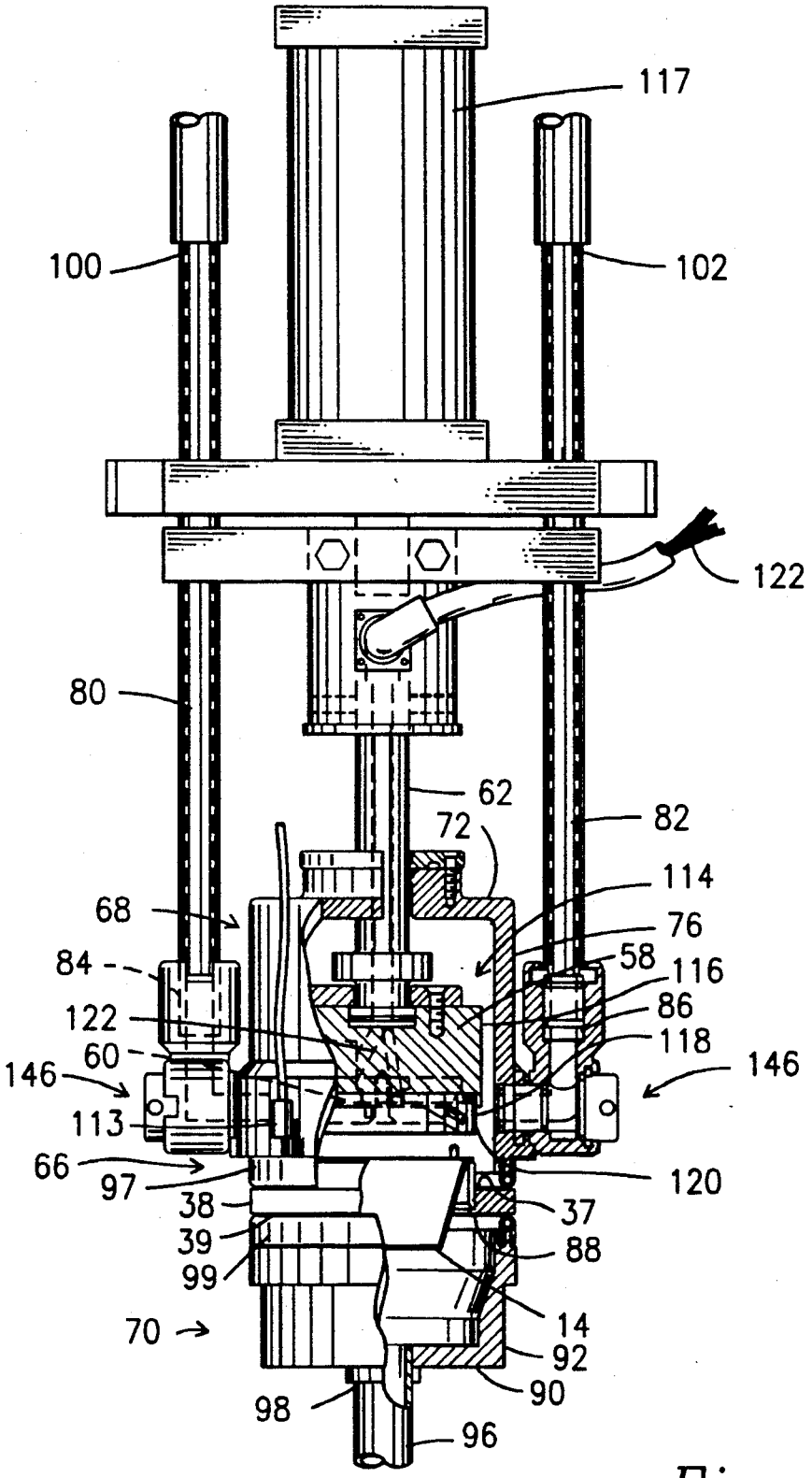
FIG. 9 is a detailed front elevational view of FIG. 7 illustrating the upper chamber portion and the lower chamber portion in the closed position and the sealing means in the storage position.
Figure 10:
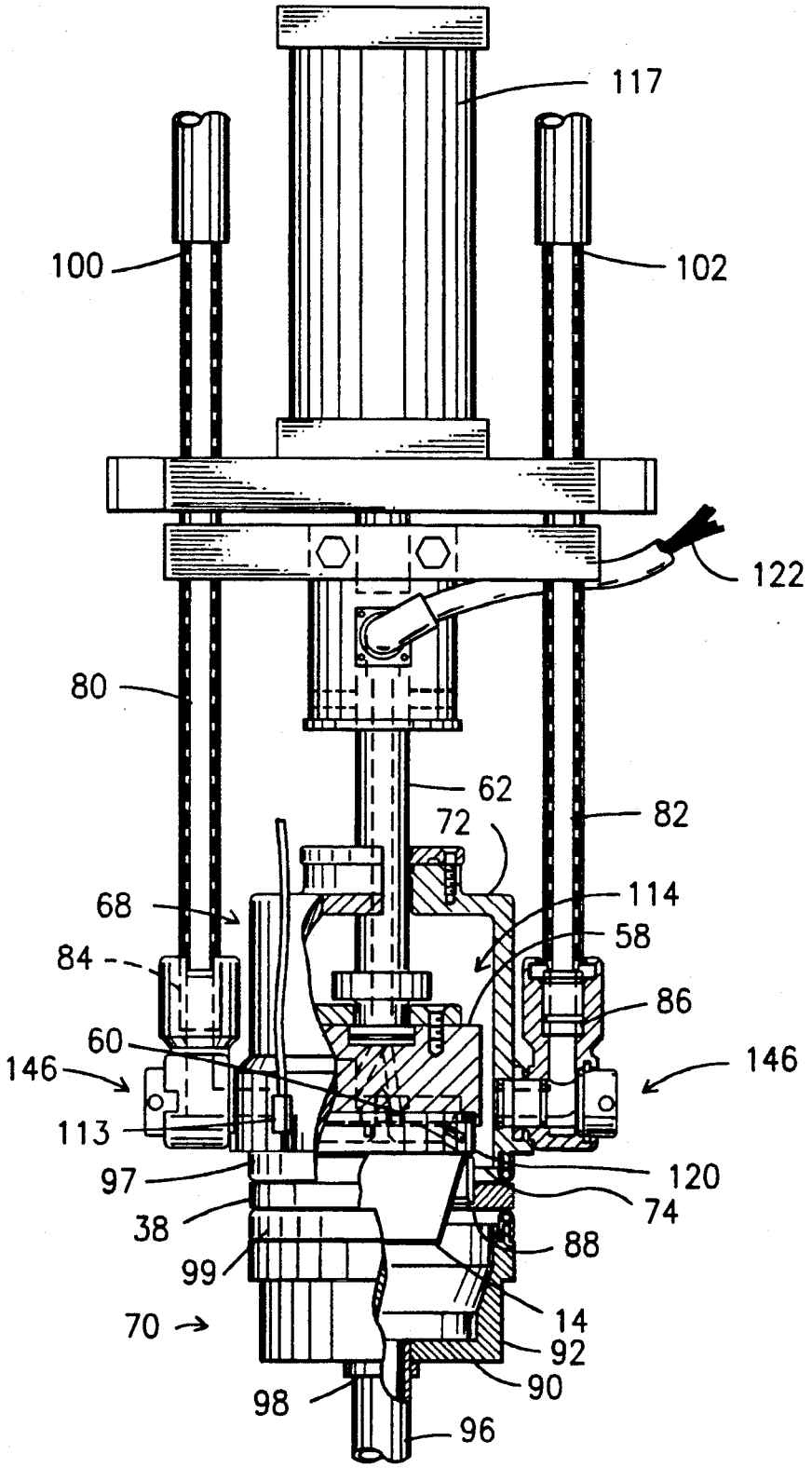
FIG. 10 is a detailed front elevation view of FIG. 7 illustrating the upper chamber portion and the lower chamber portion in the closed position and the sealing means in the sealing position.

As shown in FIGS. 8, 9 and 10, housed within the upper chamber portion 68 is a container sealing means 114 for sealing the container 14. The container sealing means 114 is very similar to the means for tacking 24 in that it has a head 116 to which is attached a seal plate 118 from which projects a ridge 120. However, while the tack ridge 64 is discontinuous leaving vents, the sealing ridge 120, as seen in FIG. 5, is continuous for totally sealing the container 14. After the evacuation and flushing of the container 14 are complete, the head 116 is moved downwardly by the seal plate operating means, conveniently pneumatic cylinder 117, until the continuous ridge 120 is pressed against the lip 36 with the lid 22 interposed therebetween. An electrical circuit 122 heats the ridge 120 so that the lid 22 is continuously heat sealed with a peelable seal to the lip 36, the container 14 being thus sealed.

Figure 11:
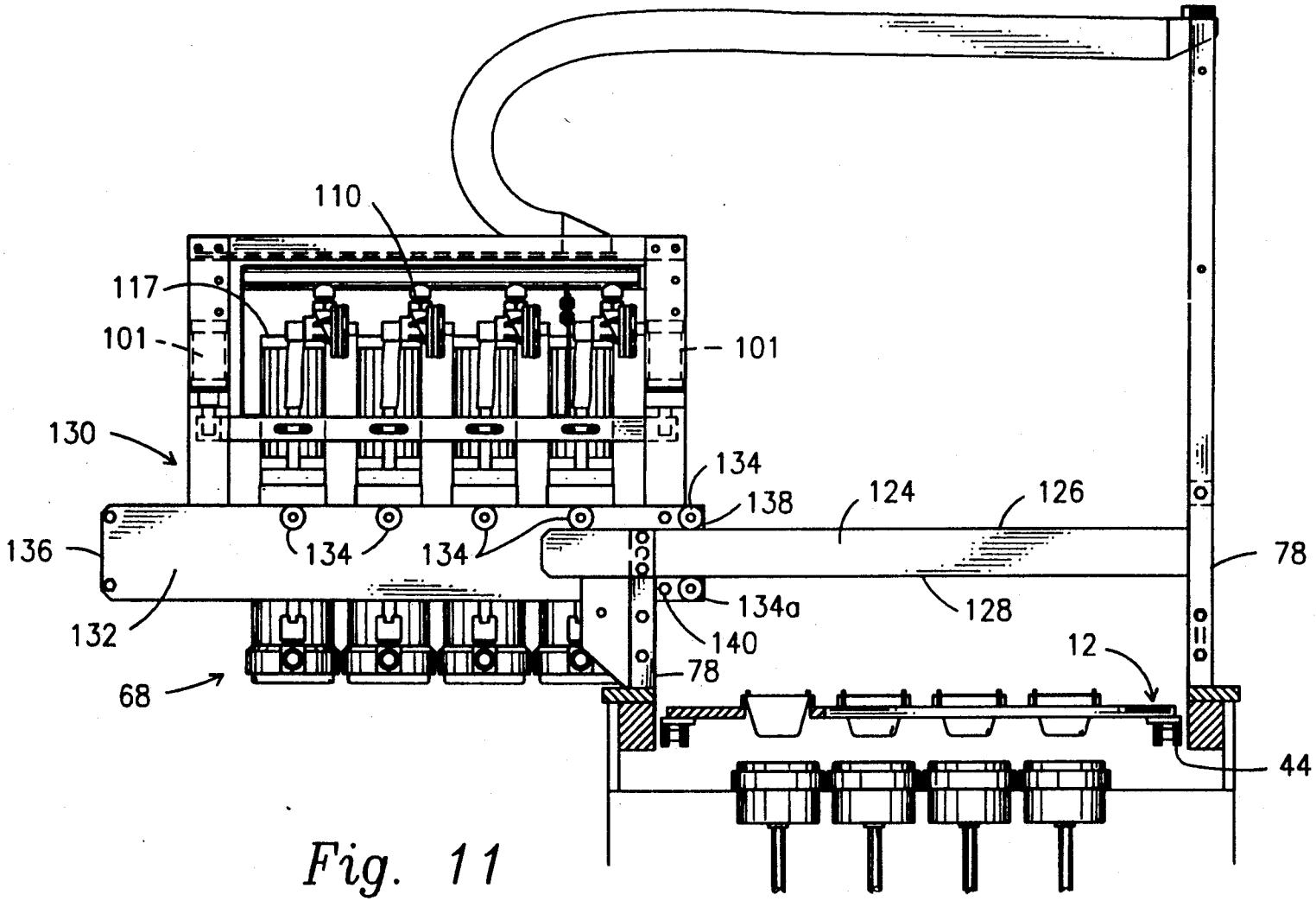
FIG. 11 is a representation of FIG. 6 illustrating the upper chamber portion and its support frame extended for access.

FIG. 11 discloses a means for obtaining easy access to the upper chamber portion 68 in order to make adjustments or for cleaning purposes. A pair of generally parallel support beams 124, each having a top surface 126 and a bottom surface 128, are attached to the support frame 78. The upper chamber support structure 130 comprises a pair of generally parallel support members 132 that are supportably connected to and thus support at least one upper chamber portion 68. A reduced friction interface, conveniently a plurality of anti-friction bearing units 134, are interposed between the top surface 126 of a respective support beam 124 and the support members 132 on which the bearing units 134 are attached. Each support member has a first end 136 and a second end 138. The bearing units 134 are attached to the support members 132 projecting outwardly therefrom in relation to the upper chamber portions 68, and are located between the first end 136 and the second end 138 of the support member 132, such that the bearing units 134 engage the top surface 126 of the support beam 124. A bearing unit **134*a* is attached proximal to the second end 138 of at least one support member 132, and is located on the support member 132 such that the bearing unit 134*a* engages the bottom surface 128 of a respective support beam 124. Now the upper chamber portion support structure 130, including the support members 132 and the upper chamber portion 66, may be moved outwardly from the support frame 78. A stop means 140 engages a part of the support frame 78, so that the upper chamber portion 68 and its support structure 130 is prevented from disengaging from the support frame 78. Being able to extend the upper chamber portion support structure 130 away from the support frame 78 permits easy access to the upper chamber portion 68 for maintenance, as shown in FIG. 11**.

Figure 12:
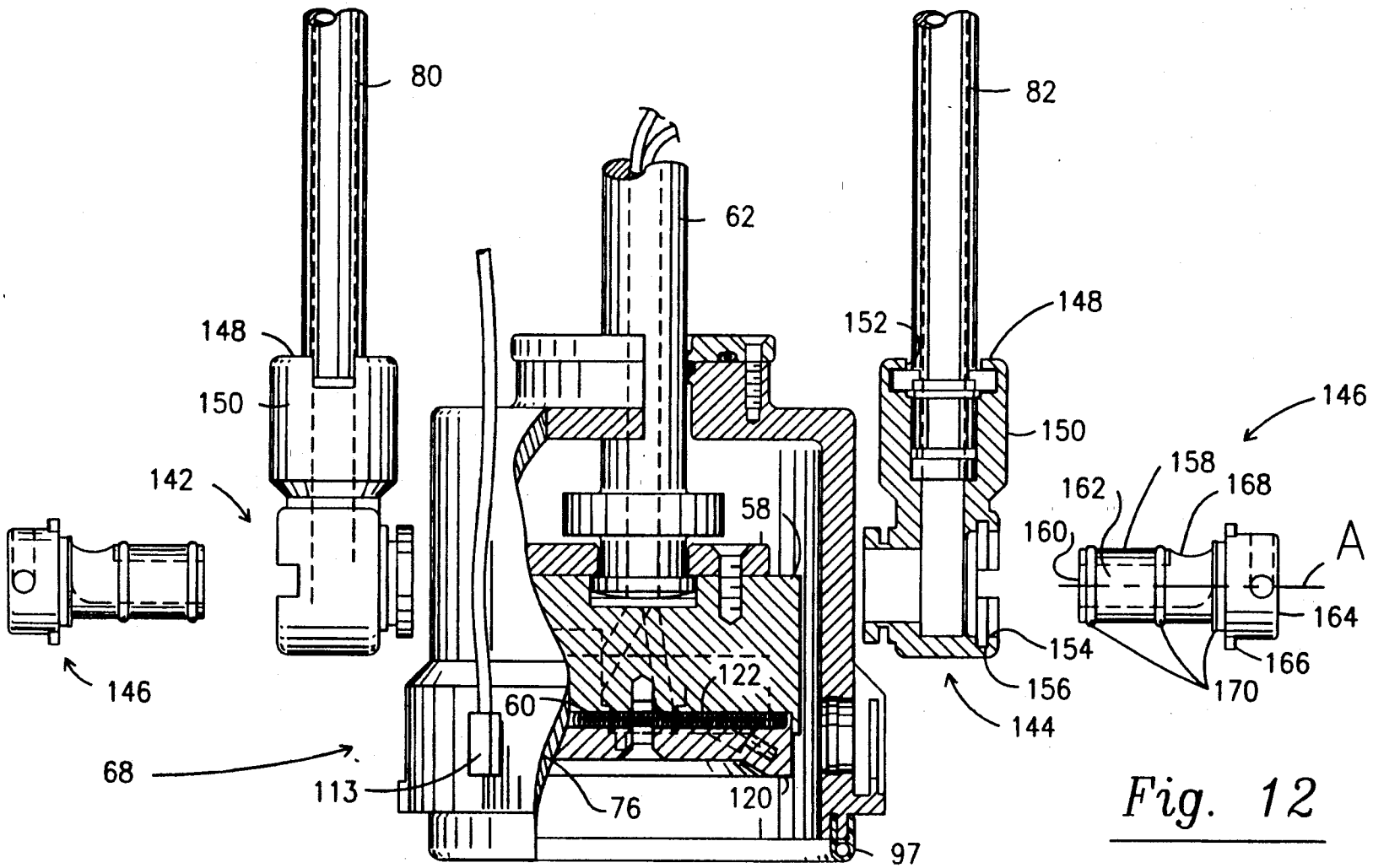
FIG. 12 is a detailed front elevational view, partially in section, of the preferred embodiment of the upper chamber portion, the releasable connectors and the hollow tubular members.

FIG. 12 illustrates the upper chamber portion 68 with a portion of the side 76 broken away and illustrates in detail a releasable connector shown generally as 142. A pair of releasable connectors 142 are used to attach the upper chamber portion 68 to the first hollow tubular member 80 on one side of the upper chamber portion 68 and the second hollow tubular member 82 on the opposing side of the upper chamber portion 68. Each releasable connector 142 is comprised of a hollow body shown generally as 144 and a hollow bolt shown generally as 146.

The hollow body 144 is comprised of a side 148 facing generally upwardly and a side 150 facing laterally outwardly. Each body 144 has an opening 152 through the upwardly facing side 148 that is sized to receive a tubular member 82 or 84 respectively. Each laterally outwardly facing side 150 has an aperture 154 therethrough that is in fluid flow communication with the hollow body 144. Each aperture 154 has a locking means 156 thereon, which in the preferred embodiment is the female portion of a bayonet style fitting that is well known in the art. Conveniently other types of fittings, for example screw threads, cotter keys and so forth may be used. The hollow bolt 146 has a longitudinal axis A, at least one side wall 158, an open first end 160 communicating with an internal compartment 162 extending axially thereof and a closed second end 164. The second end 164 has a locking means thereon, conveniently the male portion 166 of the bayonet fitting. The bolt 146 has an inlet 168 passing through the sidewall 158 and communicating with the internal compartment 162 of the bolt 146. The bolt 146 is sized and configured so that when the first end 160 of the bolt is sealingly inserted into the aperture 154 of the hollow body 144 and locked by engagement of the female portion 156 and the male portion 166 of the locking means, the inlet 168 is aligned in fluid flow communication with a respective tubular member 80 or 82, and the open first end 160 of the bolt 146 is in fluid flow communication with the upper chamber portion 68. Thus, each tubular member 80 and 82 is in fluid flow communication with one respective bolt 146, one respective body 144 and the upper chamber portion 68, forming respective closed paths between the evacuating means and the flushing means and the upper chamber portion 68. The sealing means on each bolt 146, are conveniently three o-rings 170 that engage either the upper chamber portion 68 or the hollow body 144 to provide a fluid tight seal.

With preferred embodiments of the apparatus of this invention having been described in detail above, the operation may now be described. The preferred embodiment depicted in FIG. 1 is but one preferred embodiment and illustrates a selected combination of devices used to load the containers, fill the containers, position the heat sealable lids adjacent to the containers and removed the filled and sealed containers from the packaging apparatus.

Containers 14 are stored within the de-nester 16 for delivery to the transport carrier 12. Food product is placed within the means 18 for filling the containers 14, and the lids 22 are placed within the lid dispensing means 20 for delivery to the containers 14. The controlling means 48 is activated and the drive system 43 is activated. The indexing system of the drive system 43 indicates to the controlling means when a transport carrier 12 is located in alignment with the de-nester 16. The de-nester 16 is activated by the controlling means 48 releasing four containers 14, which are pulled from their respective container holder 17 by the de-nester so that they drop into respective receptacles 40 within the transport carrier 12. The lip 36 rests upon the support ring 41 of the transport carrier 12. The transport carrier 12 is then indexed forward and positioned beneath the means for filling 18. Product is placed within the container 14 to a predetermined level. The transport carrier 12 is then indexed forward and aligned with the lid positioner, whereupon a lid 22 is dispensed and placed within the locating pins 42 of the transport carrier 12 and thus adjacent the container 14.

Figure 4:
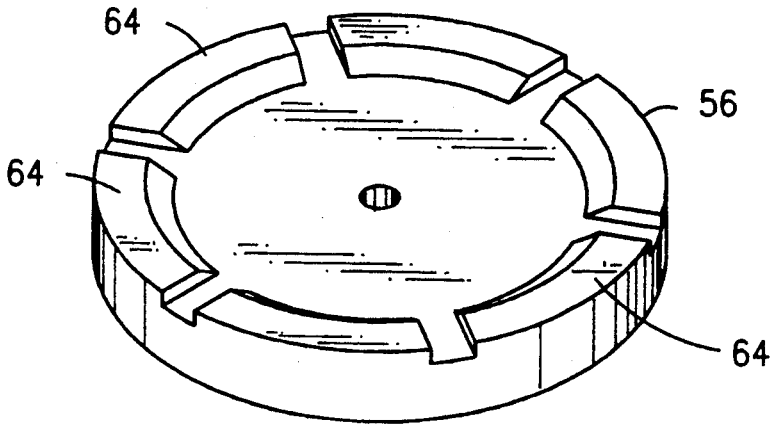
FIG. 4 is a perspective view of the tack sealing plate.

The transport carrier 12 is indexed forward and aligned with the means for tacking 24 the lid 22 to the container 14. Each individual tacking means 24 at this station is activated by the controlling means 48 causing the heads 58 to move downward, placing the heated tack plate 56 into contact with a portion of the lid 22 that is adjacent to the lip 36 of the container 14. The lid 22 is tack sealed to the container 14 in the configuration of the heated ridge 64 of the tack plate 56. Since the ridge 64 of the tack plate 56 is discontinuous, as seen in FIG. 4, six gaps will be left in the seal between the lid 22 and the container 14, which permit air to move from the container 14 or an inert gas to enter the container 14. After the head 58 is raised the transport carrier 12 is indexed to a subsequent station 26 where evacuation, flushing and final sealing occur.

With the transport carrier 12 aligned with the evacuating, flushing and sealing means 26, the controlling means 48 activates the apparatus. The upper chamber portion 68 is moved downwardly until the seal 97 engages the top surface 37 of the plate 38 of the transport carrier 12. Simultaneously, the lower chamber portion is moved upwardly until the seal 99 engages the bottom surface 39 of plate 38. Each container 14, with product therein and lid 22 tacked thereon, is now sealed within an individual chamber 66. The controlling means 48 then activates the evacuation means (not shown), which being in fluid flow communication with both the upper chamber portion 68 and the lower chamber portion 70 of the chamber 66, evacuates the air contained within the chamber 66 and the container 14. The controlling means 48 then activates the flushing means (not shown) and opens the valve means 110 and 112 so that nitrogen or other inert fluid may then pass into the chambers 66, into the containers 14 and out of the chamber by the evacuation system, which is still operating. Valve 106 and valve 108 are then closed, permitting the pressure within the chambers to reach a predetermined level. Valves 110 and 112 may then be closed and valves 106 and 108 opened to initiate a second evacuation and flushing process. Valves 110 and 112 are then reopened to permit the flushing fluid to enter and for a time to be evacuated from the chamber 66. The valves 106 and 108 are then closed and pressure is permitted to increase within the chamber to a predetermined level. A pressure sensor (not shown) within each chamber measures the pressure within the chamber whereupon when the pressure reaches the predetermined point valves 110 and 112 are closed to that individual chamber 66. Evacuation and flushing is accomplished within the upper chamber portion 68 and the lower chamber portion 70 simultaneously to prevent collapse of the containers 14 due to pressure differentials between the upper chamber portion 68 and the lower chamber portion 70. The flushing cycle may be repeated as often as necessary; however, in the preferred embodiment it is accomplished twice in order to maintain the speed of the packaging apparatus 10. Now that a predetermined pressure exists within the container 14, which may be below or above ambient pressure, the container 14 is sealed. The sealing of the container 14 is done is a similar fashion as the tacking was accomplished. A sealing head 116 which is housed within the upper chamber portion 68 is moved downwardly until the continuous ridge 120 is pressed against the lip 36 with the lid 22 interposed therebetween. The electrical circuit 122 heats the ridge 120 so that the lid 22 is continuously sealed with a peelable seal to the lip 36 of the container 14. Now that the container 14 is completely sealed, the upper chamber portion 68 and the lower chamber portion 70 are moved to their open positions so that the transport carrier 12 may be indexed to a subsequent station where the containers 14 will be removed from the transport carrier 12.

In the preferred embodiment at the last station the containers 14 are pushed up from the bottom 30 and then swept from the transport carrier 12 onto a conveyor system for subsequent movement to a packing machine.

With the upper chamber portion 68 and the lower chamber portion 70 in the open position and the packaging apparatus being shut down, the upper chamber support structure 130 may be pulled outwardly exposing the interiors of the upper chamber portions 68 and the lower chamber portions 70 for cleaning and maintenance. If necessary, the upper chamber portions may be removed from the first hollow tubular member 80 and the second hollow tubular member 82 by removing the releasable connector 142.

While the foregoing description is directed to particularly preferred embodiment of the present invention, it is to be understood that these embodiments are representative only of the principles of the invention and are not to be considered imitative thereof. Because numerous variations and modifications of both the apparatus and the method, all within the scope of the present invention, will become apparent to those skilled in the art, the scope of the invention is to be limited solely by the claims appended hereto.

What is claimed is:

1. A packaging apparatus primarily intended for use with containers that have a closed bottom, at least one side, an open top, a top edge with a lip attached thereon and a separate heat sealable lid, said apparatus having provisions for loading the containers in a transport carrier, provisions for filling the containers, provisions for placing a heat sealable lid aligned with and proximal to the lip of the container and provisions for off-loading the filled and sealed containers, the improvement comprising:

at least one station installed on at least one support frame;

at least one transport carrier supported for movement along a predetermined path, said carrier comprising at least one receptacle sized and configured to receive one said container;

means for transporting said transport carrier along said path between said stations in a predetermined sequence;

means for engaging and tacking said lid to said container;

means for evacuating, flushing and sealing said container comprising;

at least one chamber connected to said support frame, said chamber comprising;

an upper chamber portion comprising a hollow body having a closed top, open bottom and at least one side, an upper chamber portion support structure connecting said upper chamber portion to said support frame, said upper chamber portion support structure supporting said upper chamber portion for movement between an open position and a closed position;

a lower chamber portion comprising a hollow body having an open top, closed bottom and at least one side, a lower chamber portion support structure connecting said lower chamber portion to said support frame, said lower chamber support structure supporting said lower chamber portion for movement between an open and a closed position; and actuating means selectively moving said lower chamber portion and said upper chamber portion between said respective open and closed positions, such that, in said closed positions, said transport carrier is sealingly interposed between said open bottom of said upper chamber portion and said open top of said lower chamber portion, with said one container inserted in said transport carrier being enclosed by said upper chamber portion and said lower chamber portions, whereby said chamber is formed, and, in said open position, said upper chamber portion and said lower chamber portion are spaced apart so that said transport carrier with said container inserted therein may pass therebetween;

means for evacuating said chamber connected in fluid flow relation to said upper chamber portion and to said lower chamber portion;

means for flushing said chamber, connected in fluid flow relation to said upper chamber portion and to said lower chamber portion;

means for selectively controlling the flow of a fluid between said means for evacuating said chamber and said upper chamber portion, between said means for evacuation said chamber and said lower chamber portion, between said means for flushing said chamber and said upper chamber portion and between said means for flushing said chamber and said lower chamber portion;

a seal plate assembly comprising a seal plate movably housed within said upper chamber portion of said chamber, said seal plate being movable between a sealing position and a storage position, said seal plate having a continuous ridge projecting downwardly therefrom, said ridge configured to overlie said lip of said container so that, when said seal plate is in said sealing position, said lid is interposed between said ridge of said seal plate and said lip of said container;

means for heating said continuous ridge whereby said lid is attached to said lip of said container by application of said heated ridge thereto; and seal plate operating means connected to said seal plate to move said seal plate between said sealing position and said storage position; and means for controlling the operation of said packaging apparatus to effect a predetermined sequence of steps comprising evacuation and flushing of said chamber and said container during a single cycle in which air is evacuated generally simultaneously from said upper chamber portion and said lower chamber portion and then said upper chamber portion and said lower chamber portion are simultaneously flushed with a fluid, then sealing said lid to said container, said evacuation, flushing and sealing all being performed within said chamber.

2. A packaging apparatus as in claim 1 wherein said means for operatively controlling the operation of said packaging apparatus repeats said cycle of evacuating and flushing a plurality of times.

3. A packaging apparatus as in claim 1 wherein said means for controlling the flow of a fluid into and out of said chamber further comprises a set of valve means, each valve means selectively adjustable between a closed position and an open position, said set of valve means comprising a first valve means interposed in fluid flow relation between said evacuation means and said upper chamber portion, a second valve means interposed in fluid flow relation between said evacuating means and said lower chamber portion, a third valve means interposed in fluid flow relation between said flushing means and said upper chamber portion, a fourth valve means interposed in fluid flow relation between said flushing means and said lower chamber portion; and means for operating said valve means such that movement of fluid into and out of said chamber is controlled by said set of valves.

4. A packaging machine as in claim 3 wherein said means for controlling the flow of a fluid into and out of said chamber further comprises:

means for independently controlling each said set of valve means, one set of valve means for each of a plurality of chambers; and a pressure sensor connected to each said chamber and to said means for controlling said valve means of each said set of valve means such that said means for controlling said valve means effects the same predetermined sequence of pressures within each said chamber.

5. A packaging apparatus as in claim 1 wherein said lid tacking means comprises;

a tack plate slideably attached to said support frame, said tack plate having a discontinuous ridge projecting downwardly therefrom, said ridge configured to align with said lip of said container, means for heating said tack plate ridge, and means for placing said heated tack plate ridge in contact with said lid and said lid in contact with said lip, whereby said heat from said tack plate ridge tacks said lid to said lip and at least one vent is created between said lid and said lip of said container by said dicontinuity in said ridge.

6. A packaging apparatus as in claim 1 wherein said means for evacuating, flushing and sealing said container further comprises a reduced friction interface interposed between said upper chamber portion support structure and said support frame, whereby said upper chamber portion of said vacuum chamber may be moved outwardly from said support frame for easy access to said upper chamber portion.

7. A packaging apparatus as in claim 6 wherein said upper chamber portion support structure further comprises a pair of generally parallel support members, each member having a first end and a second end;

said support frame further comprises a pair of generally parallel support beams, each having a top surface and a bottom surface; and said reduced friction interface comprises a plurality of anti-friction bearing units attached to each said support member projecting outwardly therefrom, said bearing units being located between said first end and said second end of each said respective support member such that a portion of said bearing units engage said top surface of a respective one said support beam, such that said support members with said connected upper chamber portion may be moved outwardly from said support frame, one bearing unit being attached adjacent to said second end of at least one of said support members, said one bearing unit further engaging a stop means when said support members are fully moved outwardly from said support frame, whereby said upper chamber portion support structure is prevented from disengaging from said support frame.

8. A packaging apparatus as in claim 1 wherein said vacuum chamber further comprises a releasable connector interposed between each said tubular member and said upper chamber portion, said connector comprising;

a pair of hollow bodies attached in fluid flow communication to opposing sides of said upper chamber, each said body having a side facing generally upwardly and a side facing laterally outwardly from said upper chamber, each said body having an opening through said upwardly facing top portion sized to receive said tubular member, each said laterally outwardly facing side having an aperture therethrough, said aperture having a locking means therein;

said tubular member having a first open end inserted within said opening of said body and being attached thereto;

a hollow bolt having a longitudinal axis, at least one side wall, an open first end communicating with an internal compartment extending axially thereof and a closed second end, said second end having a locking means thereon, said bolt having an inlet passing through said side wall and communicating with said internal compartment of said bolt, said bolt being sized and configured such that when said first end of said bolt is sealingly inserted into said aperture and locked by engagement of said locking means, said inlet is aligned in fluid flow communication with said attached tubular member and said open first end is in fluid flow communication with said upper chamber portion, such that each said tubular member is in fluid flow communication with one said bolt, one said body and said upper chamber portion forming a respective closed path between said evacuating means, said flushing means and said upper chamber portion.

9. A packaging apparatus as in claim 1 wherein said upper chamber portion support structure further comprises first and second hollow tubular members, said first member being connected in fluid flow relation between said evacuating means and said upper chamber portion, and said second hollow tubular member being connected in fluid flow relation between said flushing means and said upper chamber portion.

10. A packaging apparatus as in claim 1 wherein said lower chamber portion support structure further comprises a hollow conduit interposed in said fluid flow relation between said evacuating means and said lower chamber portion and interposed in said fluid flow relation between said flushing means and said lower chamber portion.

11. A packaging apparatus as in claim 1 wherein said container is of semi-rigid construction.

12. A method for packaging products placed within at least one open ended semi-rigid container, said container having a lip projecting outwardly from said open end, and a separately attachable, heat sealable lid placed thereon, said method comprising the steps of:

supporting said container for movement by a transport carrier and moving said container along a predetermined path having at least one station;

moving said transport carrier and said container to a tacking means at one said station and tacking said lid to said lip of said container such that said attachment of said lid to said lip is discontinuous, providing at least one vent between said lid and said lip;

moving said transport carrier and said container to a chamber at a subsequent station;

sealing said container within said chamber;

evacuating air from said chamber and thus from said container until said chamber is substantially air free;

flushing said chamber and said container with an inert gas, further reducing the amount of air remaining in said chamber and said container;

establishing with said inert gas a predetermined pressure within said chamber;

heat sealing said lid continuously about said lip;

opening said chamber and moving said transport carrier and said container from said chamber to a subsequent station; and off-loading said sealed container from said transport carrier.

13. A method for packaging products as in claim 12 wherein said step of tacking said lid to said lip of said container further comprises the steps of:

moving a tack plate having a heated discontinuous ridge thereon, into engagement with said lid, such that said discontinuous ridge is aligned with and contacts said lid adjoining said lip, tacking said lid to said lip of said container providing at least one vent between said lid and said lip.

14. A method for packaging products as in claim 12 wherein after said flushing of said chamber and said container with an inert gas, said steps of packaging further comprises the steps of:

evacuating said chamber a second time until said chamber is substantially air free; and flushing said chamber and said container with an inert gas a second time, further reducing the amount of air remaining in said chamber and said container.

15. A method for packaging products placed within a plurality of open ended semi-rigid containers, each said container having a lip projecting outwardly from said open end, and a separate heat sealable lid placed thereon, said method comprising the steps of:

moving said containers with their respective lids along a predetermined path having at least one station, said containers being supported for movement by a transport carrier;

moving said transport carrier and said container to a tacking means at one said station, simultaneously tacking one said lid to said lip of a said container such that said attachment of said lid to said lip is discontinuous, providing at least one vent between said lid and said lip;

moving said transport carrier and said containers to a subsequent station;

enclosing each said container within a separate chamber;

evacuating each said chamber and thus each said container until each said chamber is substantially air free;

flushing each said chamber and each said container with an inert gas, further reducing the amount of air remaining in each said chamber and said container, creating a pressure within each said chamber and each said container;

sampling with pressure sensors said pressures within each said chamber and establishing with said inert gas a predetermined pressure for all said chambers within each said chamber;

heat sealing said lid continuously about said lip;

opening said chambers and moving said transport carrier, and said containers therein from said chambers to a next station; and off-loading said sealed containers from said transport carrier.

* * * * *

UNITED STATES PATENT AND TRADEMARK OFFICE

CERTIFICATE OF CORRECTION

PATENT NO. : 5,155,971

DATED : Oct. 20, 1992

INVENTOR(S) : Zopf, Thomas J.

It is certified that error appears in the above-indentified patent and that said Letters Patent is hereby corrected as shown below:

Claim 1, column 11, line 47, change "evacuation" to --evacuating--;

Claim 3, column 12, line 27, change "evacuation" to --evacuating--.

Signed and Sealed this

Twelfth Day of October, 1993

*Attest:*

Bruce Lehman

BRUCE LEHMAN

*Attesting Officer*

*Commissioner of Patents and Trademarks*